United States Patent [19]

Gercken

[11] Patent Number: 4,620,369

[45] Date of Patent: Nov. 4, 1986

[54] DRYWALL KNIFE

[76] Inventor: Richard H. Gercken, 817 Park La., Liberty, Mo. 64068

[21] Appl. No.: 639,210

[22] Filed: Aug. 9, 1984

[51] Int. Cl.[4] ..... B26B 1/00

[52] U.S. Cl. ..... 30/329; 30/168; 30/169; 30/344

[58] Field of Search ..... 30/329, 168, 169, 337, 30/344

[56] References Cited

U.S. PATENT DOCUMENTS

| | | | |
|---|---|---|---|
| 1,473,546 | 11/1923 | Eiermann | 30/169 |
| 1,779,293 | 10/1930 | Rodgers | 7/105 |
| 2,559,993 | 7/1951 | Parrigin et al. | 7/143 |
| 3,562,826 | 2/1971 | Vaughn | 30/169 |

FOREIGN PATENT DOCUMENTS

| | | | |
|---|---|---|---|
| 7858 | 8/1956 | Fed. Rep. of Germany | 30/342 |

*Primary Examiner*—E. R. Kazenske
*Assistant Examiner*—W. Fridie
*Attorney, Agent, or Firm*—Kokjer, Kircher, Bradley, Wharton, Bowman & Johnson

[57] ABSTRACT

A drywall knife includes a handle providing a hammer head and a blade which can be replaced. The blade has a main body and a projecting shank sandwiched between two separate handle portions. The handle portions are secured together and to the shank by nuts and bolts. The bolt heads are recessed in countersink areas formed in one handle portion, and the nuts are received in recesses formed in the other handle portion. The hammer head is an integral part of one handle portion and provides a hammer face on the butt end of the handle.

7 Claims, 3 Drawing Figures

DRYWALL KNIFE

BACKGROUND AND SUMMARY OF THE INVENTION

This invention relates generally to a novel drywall tool and more particularly to a drywall knife having a two piece handle which includes a hammer head end and which can be disassembled to permit replacement of the blade.

In the installation of wall board panels, drywall knives are used to apply joint compound or "mud" and to smooth it in the areas of the joints. Typically, a blade of the drywall knife is riveted or otherwise permanently attached to a handle which provides a convenient grip for holding and using the knife. Due to this permanent connection between the blade and handle, the blade normally cannot be replaced. Consequently, different blades cannot be interchanged with different handles, and the entire knife, including the handle, must be discarded when the blade is bent or otherwise damaged.

The present invention is directed to an improved drywall knife and has, as its primary goal, the provision of a drywall knife which includes a hammer head and a blade which can be easily replaced.

More specifically, it is an object of the invention to provide a drywall knife having a handle formed by two separate pieces which can be readily disconnected to permit a replacement blade to be inserted.

Another object of the invention is to provide a drywall knife in which the fasteners that serve to hold the handle together can be quickly and easily applied to and removed from the handle in order to facilitate replacement of the blade. It is an additional feature of the invention that the bolt and nut fasteners are recessed into the handle to avoid interfering with gripping of the handle or otherwise impeding use of the drywall knife.

A further object of the invention is to provide a drywall knife of the character described in which the hammer head is formed as an integral part of one of the handle portions and gradually merges with the handle grips.

A still further object of the invention is to provide a drywall knife of the character described which is constructed in a simple and economical manner and which readily accommodates blades having a variety of sizes and configurations.

Other and further objects of the invention, together with the features of novelty appurtenant thereto, will appear in the course of the following description.

DETAILED DESCRIPTION OF THE INVENTION

In the accompanying drawing which forms a part of the specification and is to be read in conjunction therewith and in which like reference numerals are used to indicate like parts in the various views.

Figure 1:
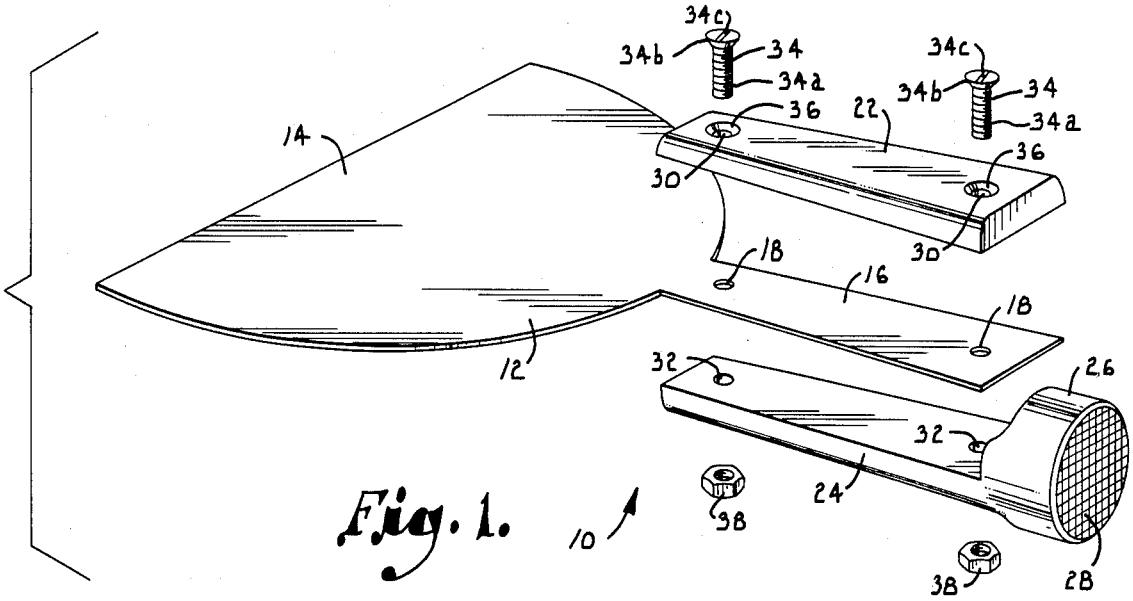
FIG. 1 is an exploded perspective view showing the components of a drywall knife constructed according to a preferred embodiment of the present invention.
Figure 2:
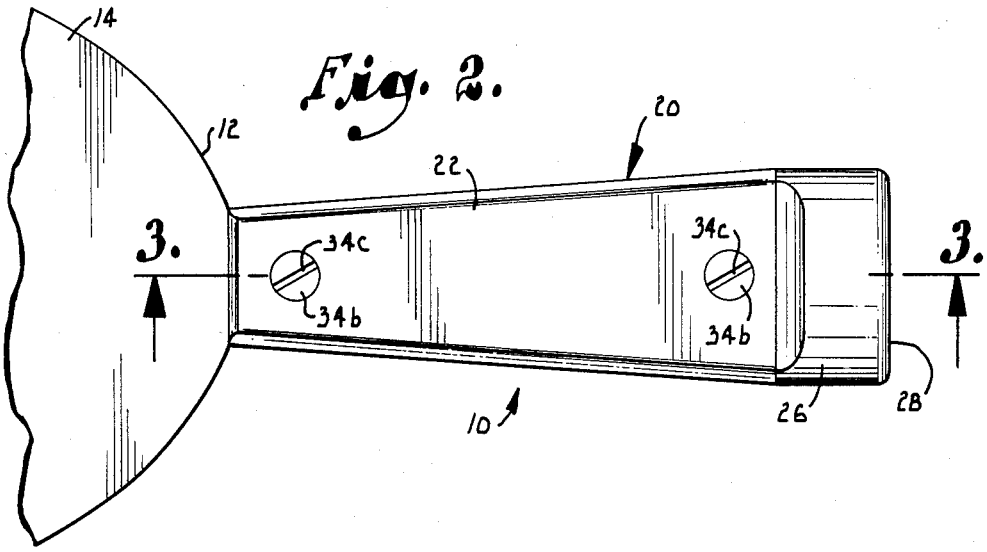
FIG. 2 is a fragmentary plan view of the drywall knife on an enlarged scale.

Referring now to the drawing in more detail, numeral 10 generally designates a drywall knife constructed in accordance with the present invention. The drywall knife 10 includes a flat blade 12 having a semicircular body 14 and a narrow shank 16 which extends from the body 14. The blade body 14 has the usual size and shape to function in the application and smoothing of drywall compound. The shank 16 has a free end and tapers from the free end toward the end which connects with the main body 14 of the blade. A pair of circular holes 18 are formed in the shank 16 near its opposite ends. The main body 14 and shank 16 are integral with one another and are coplanar.

The drywall knife blade 12 is secured to a handle 20 which provides a convenient grip for handling of the knife. The handle 20 is formed by two separate handle portions 22 and 24. The blade 12 is preferably formed from a suitable metal, while the handle portions 22 and 24 may be molded plastic or any other suitable material.

The shank 16 of the blade 12 is sandwiched between and secured to the handle portions 22 and 24. The handle portions have flat surfaces which are applied to the opposite flat sides of shank 16. For the most part, the handle portions 22 and 24 have the same shape as the shank 16. However, handle portion 24 has on one end a hammer head 26 which is molded or otherwise formed integrally with the remainder of the handle portion 24. The hammer head 26 is located on the tail or butt end of the handle 20 and terminates in a round hammer face 28 which is preferably cross hatched. The hammer head 26 gradually merges with the remainder of the handle 20.

Handle portion 22 is provided with a pair of bolt passages 30 located near its opposites ends. The other handle portion 24 has a similar pair of bolt passages 32 which align with passages 30 and with the holes 18 to provide continuous passages which receive a pair of flat head bolts 34. Each bolt includes a threaded shank **34*a* and an enlarged head 34*b* having a slot 34*c* for receiving a screw driver. A counter sink is provided for each passage 30 to form counter sink areas 36 in the outer surface of handle portion 22**.

Each bolt 34 is provided with an internally threaded nut 38 which may be tightened onto the threaded shank **34*a* of the bolt in order to secure the handle portions together and to secure the handle to the blade 12. Each nut is preferably hexagonal. The nuts 38 are located in recesses 40 formed in the outer surface of handle portion 24 at the ends of passages 32. The recesses 40 may be hexagonal in shape in order to prevent nuts 38 from rotating while the bolts 34** are threaded into or out of the nuts.

The drywall knife is assembled by applying the handle portions 22 and 24 to the opposite flat sides of shank 18. Then, the bolts 34 are extended through the bolt passages and are threaded into the nuts 38. When the bolts and nuts have been fully tightened, the bolt heads **34*b* are located in the counter sink recesses 36 and the nuts 38 are located in the recessed areas 40. In this manner, the handle portions are secured together and to shank 16, and the fasteners do not interfere with gripping of the handle 20** due to the recessed locations of the bolt heads and nuts.

The drywall knife 10 can then be used in the normal fashion to apply and smooth joint compound. The hammer head 28 is located on the tail or butt end of the handle 20 with the hammer face 28 in a convenient location to function in the intended manner. The handle 20 tapers from the butt end toward the end that connects with the main body 14 of the blade to facilitate gripping of the drywall knife.

The blade 12 can be easily removed and replaced by another blade having a different shape or size. To replace the blade, the bolts 34 are turned to thread them out of the nuts 38, and the nuts and bolts are removed so that the handle portions 22 and 24 can be separated from one another and from shank 16. The handle portions are then applied to the opposite sides of the shank of the replacement blade, and the nuts and bolts are applied in the manner described previously to secure the handle 20 to the replacement blade.

Figure 3:
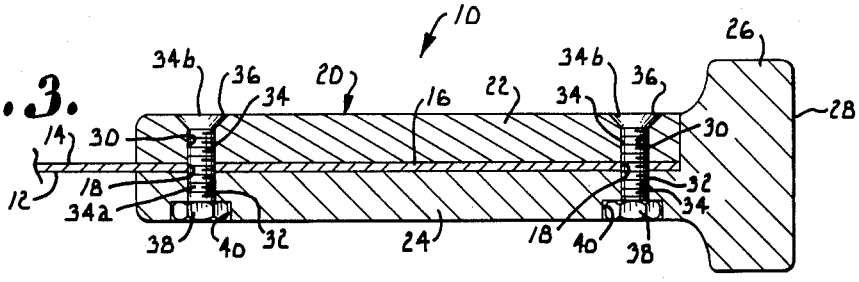
FIG. 3 is a fragmentary sectional view taken generally along line 3—3 of FIG. 2 in the direction of the arrows.

It is thus apparent that the drywall knife of the present invention provides the hammer head 26 as an integral part of the handle portion 24. The hammer face 28 is located on the butt end of the handle where it can be easily used. Only two nut and bolt assemblies are required to secure the handle together, one located near each end of the handle. This permits blade replacement to be carried out in a quick and easy manner and allows a single handle 20 to be used with a variety of blades having different sizes and shapes. At the same time, the ends of shank 16 and handle portion 22 are disposed against the hammer head 26 in the manner best shown in FIG. 3 so that the handle 20 has a compact construction and can be readily gripped in the hand to facilitate use of the drywall knife.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A drywall knife comprising:

a replaceable drywall knife blade having a flat main body adapted to apply and smooth drywall compound and a shank extending from said body, said body and shank occupying a common plane and said shank having an end remote from said body;

first and second handle portions sandwiching said shank therebetween and cooperating to form a handle having a butt end and an opposite end from which said main body of the blade projects;

a hammer head forming an integral part of said first handle portion, said hammer head being located on the butt end of said handle and presenting a hammer face which faces away from said main body of the blade, said remote end of the shank butting against said hammer head and said second handle portion having an end butting against said hammer head at a location adjacent said remote end of the shank;

a plurality of bolts extending through said handle portions and shank, each bolt having a threaded shaft and an enlarged head;

a nut applied to the shaft of each bolt to secure said handle portions together with said shank sandwiched therebetween to connect said blade with said handle, said nuts being detachable from said bolts to permit removal of the bolts and separation of said handle portions from said shank for replacement of the blade; and means for recessing said nuts and bolt heads into said first and second handle positions.

2. The invention of claim 1, wherein said recessing means includes:

a plurality of countersink recesses in said first handle portion, one for each bolt head; and a plurality of recessed areas in said second handle portion, each nut being received in one of the recessed areas when tightened on the corresponding bolt.

3. The invention of claim 2, wherein said bolts are two in number, one bolt being adjacent said butt end of the handle and the other bolt being adjacent said other end of the handle.

4. The invention of claim 3, wherein said first and second handle portions taper from said butt end of the handle toward said other end thereof.

5. A drywall knife comprising:

a replaceable drywall knife blade having a shank presenting flat opposite surfaces and an enlarged main body on one end of said shank, said shank and body being flat and coplanar and said shank having an end opposite said one end thereof;

a first handle portion disposed against one of the flat surfaces of said shank;

a second handle portion disposed against the other flat surface of said shank in opposition to said first handle portion and cooperating therewith to form a handle having a butt end;

a hammer head formed integrally on said first handle portion, said hammer head being located on said butt end of the handle and presenting a hammer face which faces away from said main body of the blade, said opposite end of the shank butting against said hammer head and said second handle portion having an end butting against said hammer head at a location adjacent said opposite end of the shank;

a plurality of removable bolts extending through said handle portions and shank, each bolt having a threaded shaft and an enlarged head;

a nut threaded onto the shaft of each bolt to secure said handle portions together with said shank sandwiched therebetween, said nuts being removable to permit removal of the bolts and detachment of said handle portions from one another and from said shank, whereby said blade can be replaced by another blade to be used with said handle and hammer head; and a plurality of recesses in said first and second handle portions for receiving said nuts and bolt heads when the nuts are tightened on the bolts.

6. The invention of claim 5, wherein said recesses include:

a plurality of countersink recesses in said first handle portion for receiving said bolt heads; and a plurality of recessed areas in said second handle portion aligned with said countersink recesses for receiving said nuts.

7. The invention of claim 5, including a plurality of passages in said handle portions and a plurality of openings in said shank aligned with said passages for receiving said bolts, said passages terminating at said recesses.

* * * * *